US005513452A

United States Patent [19]

Theurer et al.

[11] Patent Number: 5,513,452

[45] Date of Patent: May 7, 1996

[54] INSTALLATION FOR THE REHABILITATION OF A BALLAST BED

[75] Inventors: Josef Theurer, Vienna; Herbert Wörgötter, Gallneukirchen, both of Austria

[73] Assignee: Franz Plasser Bahnbaumaschinen-Industriegesellschaft M.B.H., Vienna, Austria

[21] Appl. No.: 333,434

[22] Filed: Nov. 2, 1994

[30] Foreign Application Priority Data

Dec. 1, 1993 [AT] Austria ..... 2438/93

[51] Int. Cl.[6] ..... E02F 5/22

[52] U.S. Cl. ..... 37/104; 171/16; 104/2

[58] Field of Search ..... 37/104, 105, 106, 37/107; 171/16; 104/2, 5, 7.1, 12

[56] References Cited

U.S. PATENT DOCUMENTS

| | | | |
|---|---|---|---|
| 3,137,018 | 6/1964 | Seffker | 15/55 |
| 4,042,035 | 8/1977 | Boyer | 171/16 |
| 4,534,415 | 8/1985 | Theurer et al. | 171/16 |
| 4,538,687 | 9/1985 | Theurer et al. | 104/2 X |
| 4,576,538 | 3/1986 | Theurer et al. | 104/2 X |
| 4,614,238 | 9/1986 | Theurer et al. | 104/2 X |
| 4,640,364 | 2/1987 | Theurer | 171/16 |
| 4,741,072 | 5/1988 | Wilkerson | 15/55 X |
| 5,090,483 | 2/1992 | Theurer et al. . | |
| 5,090,484 | 2/1992 | Theurer et al. . | |
| 5,094,018 | 3/1992 | Theurer et al. | 171/16 X |
| 5,289,648 | 3/1994 | Theurer et al. | 37/104 |
| 5,394,944 | 3/1995 | Theurer et al. | 171/16 |

FOREIGN PATENT DOCUMENTS 235328 8/1964 Austria .

4312585 11/1993 Germany .

OTHER PUBLICATIONS

*Eisenbahntechnische Rundshau* (Railroad Review), vol. 4, 1980, pp. 299/300.

*Primary Examiner*—Terry Lee Melius
*Assistant Examiner*—Victor Batson
*Attorney, Agent, or Firm*—Collard & Roe

[57] ABSTRACT

The installation for the rehabilitation of a ballast bed supporting a track including two rails comprises a first machine, and a second machine, the machines being supported on the track by undercarriages for movement in an operating direction, and the second machine preceding the first machine in the operating direction. A vertically adjustable ballast excavating device is mounted on the first machine for excavating ballast from underneath the track, a first conveyor arrangement is arranged to remove the excavated ballast from the ballast excavating device, a second conveyor arrangement is mounted on the first machine for conveying bulk material, the second conveyor arrangement having a discharge end rearwardly of the ballast excavating device in the operating direction and an input end arranged at an end of the first machine, and a third conveyor arrangement is mounted on the second machine for conveying the bulk material, the input end of the second conveyor arrangement being arranged to receive the bulk material from a discharge end of the third conveyor arrangement. In accordance with the invention, a clearing device is mounted on the second machine, the clearing device comprising a scraping chain for taking up bulk material lying on the track, the scraping chain revolving about a horizontal axis extending transversely to the track and having a discharge end, and an input end of the third conveyor arrangement being arranged under the discharge end of the scraping chain.

7 Claims, 2 Drawing Sheets

INSTALLATION FOR THE REHABILITATION OF A BALLAST BED

BACKGROUND OF THE INVENTION

1. Field of the Invention

The present invention relates to an installation for the rehabilitation of a ballast bed supporting a track including two rails, which comprises a first machine, a second machine, the machines being supported on the track by undercarriages for movement in an operating direction, and the second machine preceding the first machine in the operating direction. A vertically adjustable ballast excavating device is mounted on the first machine for excavating ballast from underneath the track, a first conveyor arrangement is arranged to remove the excavated ballast from the ballast excavating device, a second conveyor arrangement is mounted on the first machine for conveying bulk material, the second conveyor arrangement having a discharge end rearwardly of the ballast excavating device in the operating direction and an input end arranged at an end of the first machine, and a third conveyor arrangement is mounted on the second machine for conveying the bulk material, the input end of the second conveyor arrangement being arranged to receive the bulk material from a discharge end of the third conveyor arrangement.

2. Description of the Prior Art

An ballast bed rehabilitation installation of this type has been disclosed in our copending U.S. patent application Ser. No. 08/036,712, filed Mar. 25, 1993, now U.S. Pat. No. 5,394,944 (which corresponds to German patent application No. 4,312,585, published Nov. 4, 1993). As this installation continuously advances along the track, dirty ballast is excavated by the vertically adjustable ballast excavating device and removed by a first conveyor arrangement to a ballast screening device for cleaning. The cleaned ballast is returned by a second conveyor arrangement and discharged on the subgrade from which the dirty ballast was removed by the ballast excavating device. A third conveyor arrangement is arranged to convey additional clean ballast to the second conveyor arrangement from a storage car of clean ballast in case of need for such additional ballast, either to replace excessive amounts of detritus in the excavated ballast or to increase the height of the ballast bed.

U.S. Pat. No. 5,090,484 discloses a mobile ballast cleaning machine installation which comprises a first machine frame carrying two vertically adjustable ballast excavating devices for excavating dirty ballast from the track shoulders. The excavated ballast is cleaned on a screen arrangement mounted on a second machine frame succeeding the first machine frame in the operating direction, and the cleaned ballast is discharged on the track bed. A third machine frame succeeding the second machine frame in the operating direction carries another ballast excavating device for removing dirty ballast from under the track and to clean it on another screen arrangement. The cleaned ballast lying on the track is taken up from the ties by an endless conveyor chain and redistributed in the excavated ballast bed portion behind the transverse excavating chain course of the other ballast excavating device, together with the cleaned ballast coming from the other screen arrangement. This installation increases the efficiency of ballast cleaning in an intermittent operation with the aid of three spaced apart ballast excavating devices.

A sand clearing machine for operation in desert regions and known as SRM 500 is described in "Eisenbahntechnische Rundschau," (Railroad Review), Vol. 4, 1980, pp.299/300. This machine is designed to remove sand blown over a track and comprises a sand clearing elevator cantilevered to the front end of the machine. The removed sand is discharged at a track shoulder by a conveyor band arrangement.

Other ballast bed rehabilitation installations of interest are disclosed in U.S. Pat. No. 5,090,483 and Austrian patent No. 235,328.

SUMMARY OF THE INVENTION

It is the primary object of this invention to provide a ballast bed rehabilitation installation of the first-described type which is operable with a reduced structural complexity for rehabilitating ballast beds requiring relatively large amounts of bulk material.

The installation for the rehabilitation of a ballast bed supporting a track including two rails comprises a first machine, and a second machine, the machines being supported on the track by undercarriages for movement in an operating direction, and the second machine preceding the first machine in the operating direction. A vertically adjustable ballast excavating device is mounted on the first machine for excavating ballast from underneath the track, a first conveyor arrangement is arranged to remove the excavated ballast from the ballast excavating device, a second conveyor arrangement is mounted on the first machine for conveying bulk material, the second conveyor arrangement having a discharge end rearwardly of the ballast excavating device in the operating direction and an input end arranged at an end of the first machine, and a third conveyor arrangement is mounted on the second machine for conveying the bulk material, the input end of the second conveyor arrangement being arranged to receive the bulk material from a discharge end of the third conveyor arrangement. In accordance with the invention, a clearing device is mounted on the second machine, the clearing device comprising a scraping chain for taking up bulk material lying on the track, the scraping chain revolving about a horizontal axis extending transversely to the track and having a discharge end, and an input end of the third conveyor arrangement being arranged under the discharge end of the scraping chain.

This arrangement offers the possibility to store bulk material, such as clean ballast, which may be required for the rehabilitation of the ballast bed, independently of the time at which the installation is operated on the track. This simplifies the logistics for the timely availability of the bulk material. Furthermore, it does away with the need for special storage and transport cars. Since the bulk material may be stored along the entire length of the track whose bed is to be rehabilitated, the output of the installation is advantageously entirely independent of the storage capacity of bulk material storage cars.

The clearing device preferably comprises a carrier frame for the scraping chain, and two flanged rollers spaced transversely to the track and supporting the carrier frame on the track rails, and the installation further comprises vertical adjustment drive means linking the carrier frame to the second machine. This assures a constant spacing of the scraping chain from the bulk material stored on the track so that the scraping chain will take up substantially all of the bulk material lying on the track ties. In addition, this arrangement automatically centers the scraping chain between the track rails.

In the preferred embodiments assuring a trouble-free, continuous taking up of the bulk material from the track, the installation may further comprise tunnel devices spaced transversely to the track and extending in a longitudinal direction for covering the track rails in an area where the scraping chain takes up the bulk material lying on the track, the tunnel devices being connected to the carrier frame. Also, deflection flaps may be pivotally mounted on the carrier frame for pivoting about vertical axes for deflecting the bulk material taken up by the scraping chain, the deflection flaps being positioned between the track rails. Furthermore, the scraping chain may have a low point and a section rising from the low point and enclosing an acute angle with the track plane, the rising scraping chain section preceding the low point in the operating direction.

A secure positioning of the scraping chain between the track rails and an optimal use of the storage space for the bulk material on the track is assured if the clearing device is arranged symmetrically with respect to a vertical plane extending in the longitudinal direction of the second machine and bisecting the undercarriages supporting the second machine at a midpoint thereof, the undercarriages having a gage exceeding the width of the scraping chain.

Brief intermediate storing of the bulk material taken up by the scraping chain can be obtained to equalize different bulk material requirements while maintaining the continuous conveyance of the bulk material if the installation further comprises a storage car for the bulk material arranged between the first and second machines, the storage car comprising a longitudinally extending bottom conveyor band arranged to receive the bulk material from the discharge end of the third conveyor arrangement, and a rising transfer conveyor band succeeding the bottom conveyor band in the operating direction and arranged to receive the bulk material from the bottom conveyor band and to transfer the bulk material to the input end of the second conveyor arrangement.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
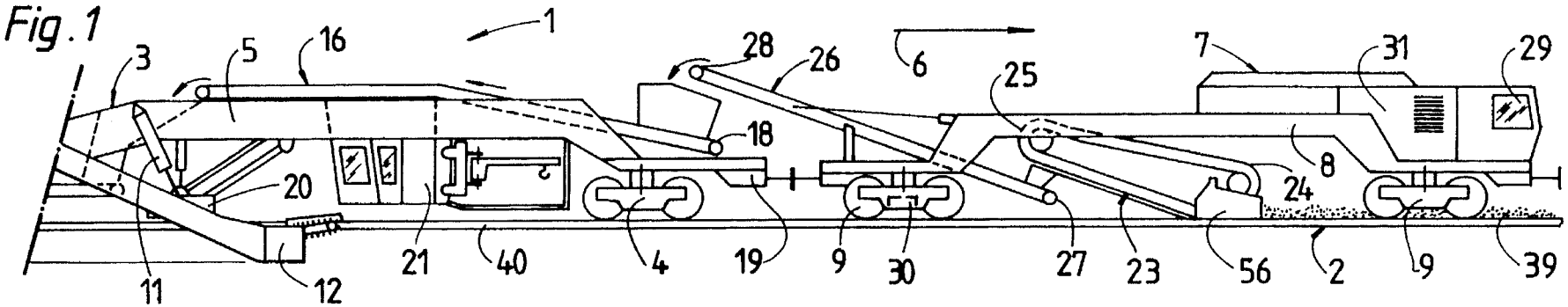
FIGS. 1 and 2 show a side elevational view of a ballast bed rehabilitation installation according to this invention, FIG. 1 illustrating the front portion of the installation in the operating direction and FIG. 2 illustrating the rear portion.
Figure 2:
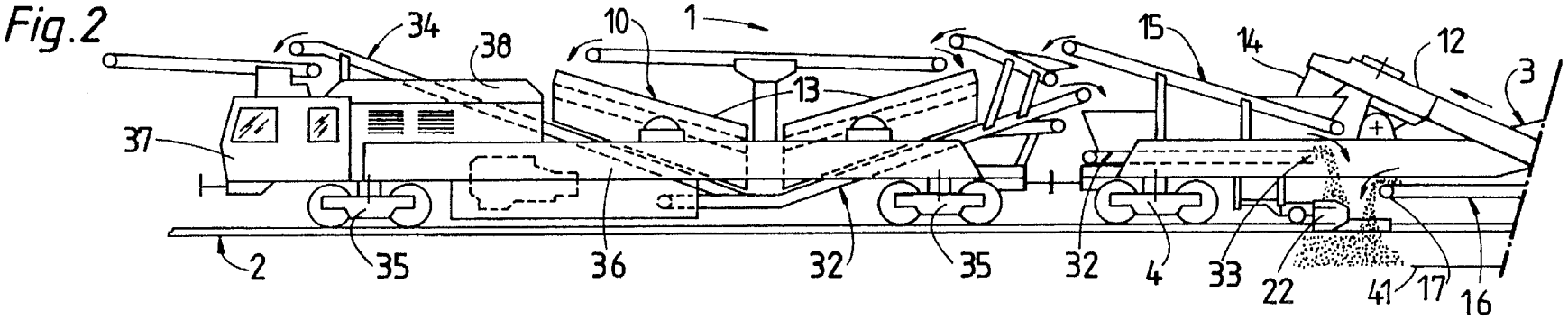

Referring now to the drawing wherein like reference numerals designate like parts functioning in a like manner in all figures, FIGS. 1 and 2 show installation 1 for the rehabilitation of a ballast bed supporting track 2 including two rails 40. The installation comprises first machine 3, second machine 7, the machines respectively comprising machine frames 5 and 8 being supported on track 2 by undercarriages 4 and 9, respectively, for movement in an operating direction indicated by arrow 6. Second machine 7 precedes first machine 3 in the operating direction. For cleaning the excavated ballast, ballast screening car 10 is coupled to rear machine 3.

Vertically adjustable ballast excavating device 12 is mounted on machine frame 5 of first machine 3 for excavating ballast from underneath track 2. Drives 11 link the ballast excavating device to machine frame 5 for adjusting the device vertically and laterally, and the device comprises an endless revolving scraper chain including a transversely extending chain course running underneath track 2 through the ballast bed. First conveyor arrangement 15 is arranged between a discharge end 14 of ballast excavating device 12 and ballast screening arrangement 13 on ballast screening car 10 to remove the excavated ballast from the ballast excavating device for cleaning. Second conveyor arrangement 16 is also mounted on machine frame 5 for conveying bulk material, such as clean ballast, the second conveyor arrangement having discharge end 17 rearwardly of the transverse excavating chain course of ballast excavating device 12 in the operating direction and input end 18 arranged at front end 19 of machine frame 5 of first machine 3.

The first machine also carries a vertically and transversely adjustable track lifting unit 20, operator's cab 21 within view of the ballast excavating site, and ballast planing plow 22 for smoothing the clean ballast redistributed on subgrade 41 from which the dirty ballast has been removed.

Figure 6:
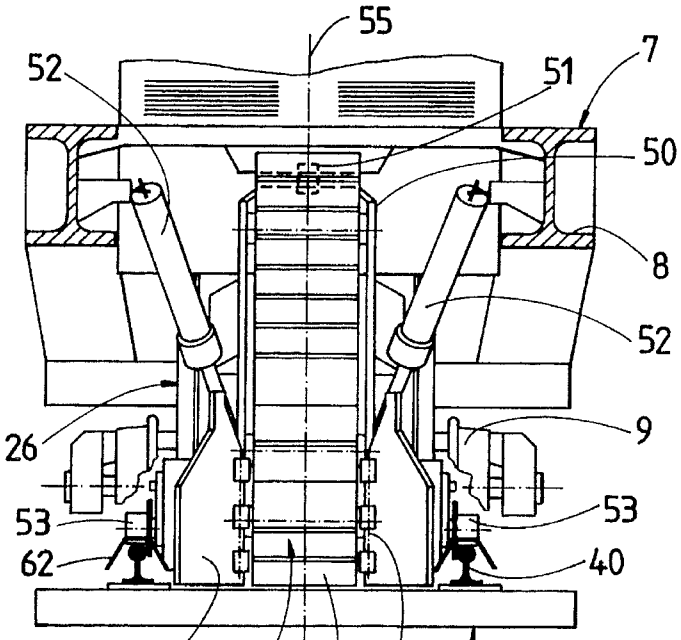
FIG. 6 is an end view of the clearing device, seen in the direction of arrow VI of FIG. 5.
Figure 5:
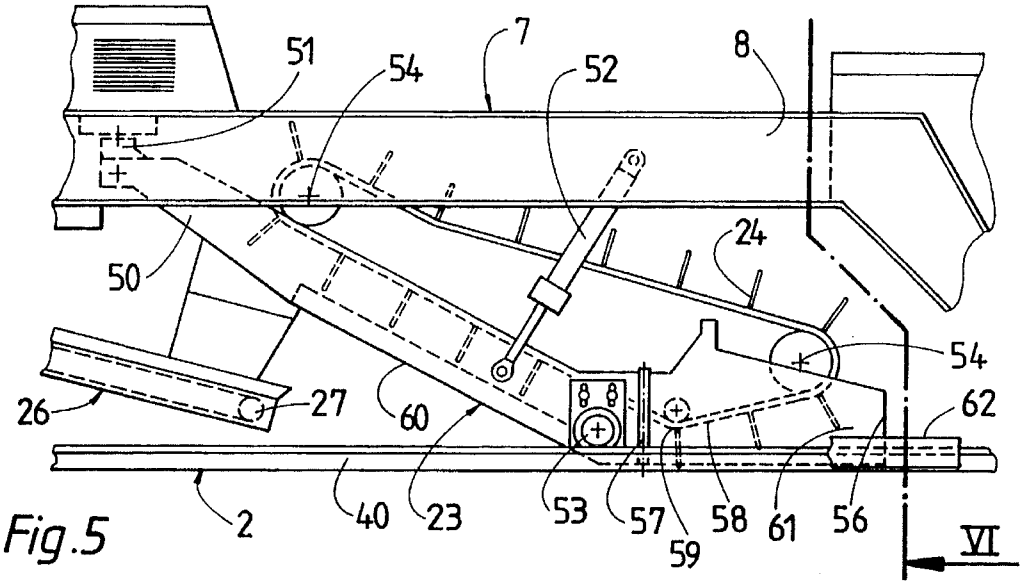
FIG. 5 is an enlarged side elevational view of the clearing device of this invention.

As shown in FIG. 1, third conveyor arrangement 26 is mounted on second machine 7 for conveying the bulk material, such as new ballast 39 stored on track 2, input end 18 of second conveyor arrangement 16 being arranged to receive the bulk material from discharge end 28 of third conveyor arrangement 26. Clearing device 23 is mounted on machine frame 8 of first machine 7 in an upwardly recessed portion of the machine frame. This clearing device is best shown in FIGS. 5 and 6 and comprises scraping chain 24 for taking up bulk material 39 lying on track 2. Scraping chain 24 revolves about horizontal axes 54 extending transversely to the track and has discharge end 25, and input end 27 of third conveyor arrangement 26 is arranged under discharge end 25 of scraping chain 24. The front end of machine frame 8 carries engineer's cab 29 and power plant 31 supplying energy to all the operating drives of the installation.

As shown in FIG. 2, conveyor arrangement 32 running in the longitudinal direction of the installation has a conveyor portion mounted on car 10 for receiving the cleaned ballast from screening arrangement 13 and conveying the cleaned ballast to a conveyor portion mounted on machine 3. Discharge end 33 of conveyor arrangement 32 discharges the cleaned ballast above ballast plow 22. Detritus coming from screening arrangement 13 is removed by a further conveyor 34 to the rear. Frame 36 of ballast screening car 10 is supported on track 2 by undercarriages 35 and carries operator's cab 37 and power plant 38 supplying energy to the vibrating screens of the ballast screening arrangement.

As shown in detail in FIGS. 5 and 6, clearing device 23 comprises carrier frame 50 for scraping chain 24, and two flanged rollers 53 spaced transversely to track 2 and supporting the carrier frame on track rails 40. Vertical adjustment drives 52 link carrier frame 50 to the machine frame of second machine 7 for vertically and laterally adjusting the clearing device, and universal joint 51 mounts the carrier frame on machine frame 8. Tunnel devices 62 are spaced transversely to track 2 and extend in a longitudinal direction for covering track rails 40 in area 61 where scraping chain 24 takes up bulk material 39 lying on track 2, the tunnel devices being connected to carrier frame 50.

Furthermore, two deflection flaps 56 are pivotally mounted on the lower front end of carrier frame 50 for pivoting about vertical axes 57 for deflecting the bulk material taken up by the scraping chain, the deflection flaps being positioned between track rails 40. During operation, deflection flaps 56 are outwardly pivoted so that their front ends in the operating direction are close to respective track rails 40, thus deflecting bulk material 39 towards the center, i.e. to scraping chain 24. Clearing device 23 is arranged symmetrically with respect to vertical plane 55 extending in the longitudinal direction of second machine 7 and bisecting undercarriages 9 supporting its machine frame at a midpoint thereof, undercarriages 9 having a gage exceeding the width of scraping chain 24. The scraping chain has a low point 59 and a section 58 rising from the low point and enclosing an acute angle with the track plane, the rising scraping chain section preceding the low point in the operating direction. The rising scraping chain section enables the scraping chain to clear even relatively high accumulations of bulk material without any problems, and guide metal sheets 60 will smoothly guide the bulk material to input end 27 of third conveyor arrangement 26.

Figure 3:
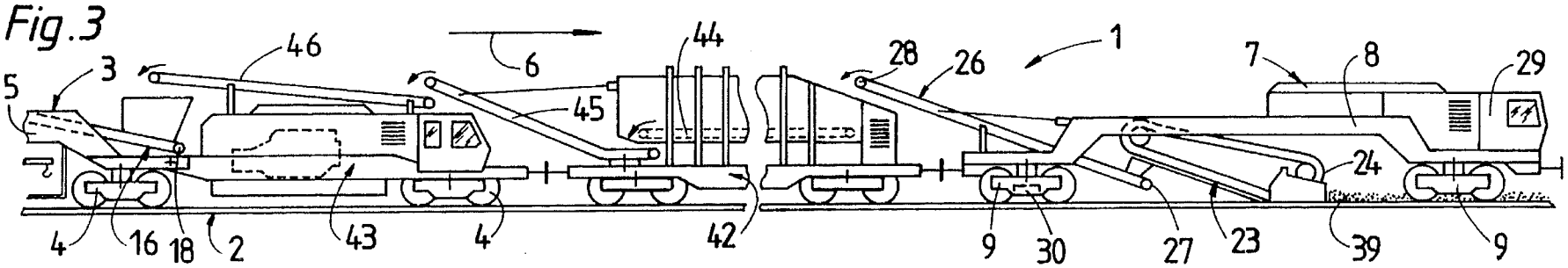
FIG. 3 is a like side elevation of another embodiment of the installation.

FIG. 3 illustrates an embodiment of installation 1, which comprises a storage car 42 for the bulk material arranged between the first and second machines 3 and 7, the storage car comprising longitudinally extending bottom conveyor band 44 arranged to receive the bulk material from discharge end 28 of third conveyor arrangement 26, and rising transfer conveyor band 45 succeeding bottom conveyor band 44 in the operating direction and arranged to receive the bulk material from the bottom conveyor band and to transfer the bulk material to input end 18 of second conveyor arrangement 16. Locomotive 43 is arranged between storage car 42 and first machine 3, and the locomotive carries another conveyor band 46 receiving the bulk material from transfer conveyor band 45 and conveying it to input end 18. In other words, conveyor bands 44, 45, 46 provide an extension of second conveyor arrangement 16. By changing the speed of bottom conveyor band 44 in storage car 42, it is possible to store the bulk material temporarily in the car or to deliver more bulk material to subgrade 41, according to local requirements.

Ballast bed rehabilitation installation 1 operates in the following manner:

Before the installation is put in operation, desired amounts of clean ballast 39 are deposited between track rails 40 on track 2. During operation, the installation is advanced continuously in the operating direction indicated by arrow 6, scraping chain 24 is revolved to take up the clean ballast from the track, and the clean ballast cleared from the track is conveyed by third conveyor arrangement 26 to succeeding second conveyor arrangement 16.

At the same time, ballast excavating device 12 is operated continuously to excavate dirty ballast from underneath track 2 and the excavated ballast is conveyed by first conveyor arrangement 15 to screening arrangement 13 for cleaning. Conveyor band arrangement 32 conveys the cleaned ballast from the screening arrangement to subgrade 41 which has been exposed by the excavation of the dirty ballast. The required amount of additional clean ballast 39 is discharged to the exposed subgrade from discharge end 17 of second conveyor arrangement 16. This addition of clean ballast compensates for the detritus of the excavated ballast removed by screening arrangement 13. It may also be used to obtain improved ballasting of the track.

Installation 1 may alternatively be used without ballast screening car 10 in an operation wherein the entire dirty ballast bed is removed and replaced by entirely new ballast. In this case, the dirty ballast is removed by first conveyor band arrangement 15 to storage cars coupled to first machine 3, and all the required ballast for a new bed is supplied by clean ballast 39 taken up by clearing device 23 and conveyed to exposed subgrade 41 by third and second conveyor band arrangements 26 and 16. In this case, it may be advantageous to cantilever clearing device 23 to the front end of machine frame 8 to enable it to handle large amounts of bulk material.

Figure 4:
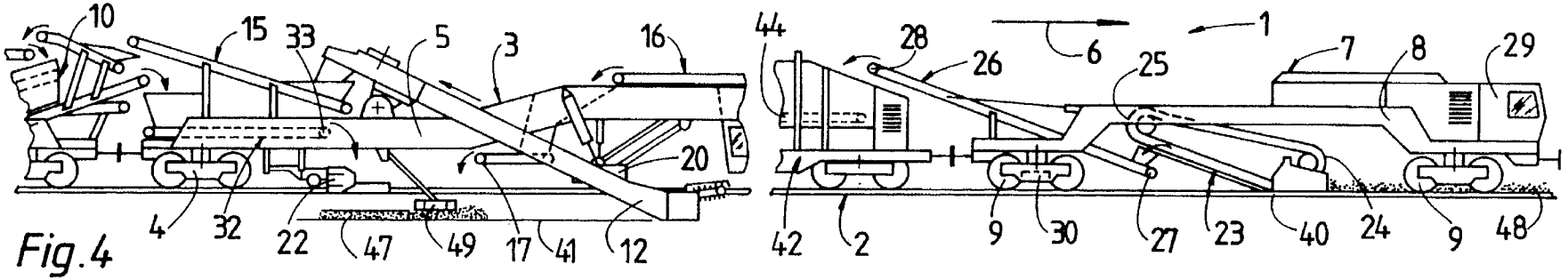
FIG. 4 shows a like side elevation of a modification of the installation of FIG. 3.

FIG. 4 illustrates an embodiment of installation 1 designed to lay a protective layer 47 of sand on exposed subgrade 41. As in the embodiment described hereinabove in connection with FIG. 3, the installation comprises first machine 3, second machine 7, storage car 42 arranged therebetween, and screening car 10 coupled to the rear end of the first machine. In contrast to the embodiments heretofore described and illustrated, however, the final conveyor band of second conveyor arrangement 16 is relatively short, i.e. discharge end 17 of the second conveyor arrangement behind ballast excavating device 12 is spaced some distance from plow 22 in the longitudinal direction, and vertically adjustable, vibratory compacting device 49 is pivotally linked to machine frame 5 and extends into the space between discharge end 17 and plow 22.

In the operation of this installation, a suitable bulk material 48 designed to provide protective layer 47 for subgrade 41, such as sand, is placed on track 2 between track rails 40. As in the previously described embodiments, clearing device 23 takes up bulk material 48 as installation 1 advances along the track, and the bulk material is conveyed by third conveyor arrangement 26 to storage car 42 for intermediate storage of the bulk material, and for conveyance by second conveyor arrangement 16 to discharge end 17. Meanwhile, ballast excavating device 12 has excavated the dirty ballast from underneath track 2 to expose subgrade 41, and bulk material 48 is discharged from discharge end 17 on the exposed subgrade where it is compacted and smoothed by vibratory compacting device 49 to form protective layer 47 on subgrade 41. The dirty ballast is cleaned on screening car 10, the cleaned ballast is returned by conveyor band 32, discharged from discharge end 33 onto protective layer 47, and smoothed by plow 22.

What is claimed is:

1. An installation for the rehabilitation of a ballast bed supporting a track including two rails, which comprises (a) a first machine, (b) a second machine, (1) the machines being supported on the track by undercarriages for movement in an operating direction, and (2) the second machine preceding the first machine in the operating direction, (c) a vertically adjustable ballast excavating device mounted on the first machine for excavating ballast from underneath the track, (d) a first conveyor arrangement arranged to remove the excavated ballast from the ballast excavating device, (e) a second conveyor arrangement for conveying clean bulk material from the second to the first machine, the second conveyor arrangement having a discharge end rearwardly of the ballast excavating device in the operating direction, and (f) a clearing device mounted on the second machine, the clearing device comprising (1) a scraping chain arranged to take up clean bulk material lying on the track, the scraping chain revolving about a horizontal axis extending transversely to the track and having a discharge end, and (2) an input end of the second conveyor arrangement being arranged under the discharge end of the scraping chain.

2. The installation of claim 1, wherein the clearing device comprises a carrier frame for the scraping chain, and two flanged rollers spaced transversely to the track and supporting the carrier frame on the track rails, and further comprising vertical adjustment drive means linking the carrier frame to the second machine.

3. The installation of claim 2, further comprising tunnel devices spaced transversely to the track and extending in a longitudinal direction for covering the track rails in an area where the scraping chain takes up the bulk material lying on the track, the tunnel devices being connected to the carrier frame.

4. The installation of claim 2, further comprising deflection flaps pivotally mounted on the carrier frame for pivoting about vertical axes for deflecting the bulk material taken up by the scraping chain, the deflection flaps being positioned between the track rails.

5. The installation of claim 1, wherein the clearing device is arranged symmetrically with respect to a vertical plane extending in the longitudinal direction of the second machine and bisecting the undercarriages supporting the second machine frame at a midpoint thereof, the undercarriages having a gage exceeding the width of the scraping chain.

6. The installation of claim 1, wherein the scraping chain has a low point and a section rising from the low point and enclosing an acute angle with the track plane, the rising scraping chain section preceding the low point in the operating direction.

7. The installation of claim 1, wherein the second conveyor arrangement comprises a conveyor mounted on the second machine and another conveyor mounted on the first machine, further comprising a storage car for the bulk material arranged between the first and second machines, the storage car comprising a longitudinally extending bottom conveyor band arranged to receive the clean bulk material from the conveyor, and a rising transfer conveyor band succeeding the bottom conveyor band in the operating direction and arranged to receive the clean bulk material from the bottom conveyor band and to transfer the clean bulk material to the other conveyor.

* * * * *